US006615598B1

(12) United States Patent
Wang et al.

(10) Patent No.: US 6,615,598 B1
(45) Date of Patent: Sep. 9, 2003

(54) SCROLL MACHINE WITH LIQUID INJECTION

(75) Inventors: Simon Y. Wang, Hong Kong (HK); Wayne R. Berry, Hong Kong (HK)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 10/106,079

(22) Filed: Mar. 26, 2002

(51) Int. Cl.[7] ..... F25B 31/00; F25B 41/00

(52) U.S. Cl. ..... 62/197; 62/505; 62/209; 62/498

(58) Field of Search ..... 62/115, 505, 209, 62/498, DIG. 2, DIG. 17, 197

(56) References Cited

U.S. PATENT DOCUMENTS 5,752,391 A * 5/1998 Ozaki et al. ..... 62/228.1
6,038,875 A * 3/2000 Haselden ..... 62/218
6,076,367 A * 6/2000 Sandofsky et al. ..... 62/209
6,098,421 A * 8/2000 Fujita et al. ..... 62/505
6,185,944 B1 * 2/2001 Gaul ..... 62/115
6,295,821 B1 * 10/2001 Madigan ..... 62/117
6,438,979 B2 * 8/2002 Fujita et al. ..... 62/183
6,474,087 B1 * 11/2002 Lifson ..... 62/199

* cited by examiner

*Primary Examiner*—William C. Doerrler
*Assistant Examiner*—Mark Shulman
(74) *Attorney, Agent, or Firm*—Harness, Dickey & Pierce, P.L.C.

(57) ABSTRACT

A refrigeration circuit includes a scroll compressor, a condenser and an evaporator connected in a closed loop. A liquid injection system takes liquid refrigerant from the refrigerant circuit and injects it into a suction line leading to the compressor to cool the refrigerant in the refrigeration circuit. An electronic control unit operates a controllable valve based on a temperature reading received from a discharge gas temperature sensor. The controllable valve can be an electronic expansion valve or a solenoid valve.

8 Claims, 3 Drawing Sheets

SCROLL MACHINE WITH LIQUID INJECTION

FIELD OF THE INVENTION

The present invention relates generally to scroll-type machines. More particularly, the present invention relates to hermetic scroll compressors incorporating a fluid injection system where the fluid injection system injects the fluid into the suction line of the compressor when a temperature limit is exceeded.

BACKGROUND AND SUMMARY OF THE INVENTION

Refrigeration and air conditioning systems generally include a compressor, a condenser, an expansion valve or an equivalent and an evaporator. These components are coupled in sequence in a continuous flow path. A working fluid flows through the system and alternates between a liquid phase and a vapor or gaseous phase.

A variety of compressor types have been used in refrigeration systems, including but not limited to reciprocating compressors, screw compressors and rotary compressors. Rotary type compressors can include the various vane type compressors as well as scroll machines. Scroll machines or scroll compressors are constructed using two scroll members with each scroll member having an end plate and a spiral wrap. The scroll members are mounted so that they may engage in relative orbiting motion with respect to each other. During this orbiting movement, the spiral wraps define a successive series of enclosed spaces or crescent shaped pockets, each of which progressively decrease in size as it moves inwardly from a radial outer position at a relatively low suction pressure to a central position at a relatively high discharge pressure. The compressed gas exits from the enclosed space at the central position through a discharge passage formed through the end plate of one of the scroll members.

In the normal refrigeration cycle, vapor is drawn into a compressor where it is compressed to a higher pressure. The compressed vapor is cooled and condensed in a condenser into a high pressure liquid which is then expanded, typically through an expansion valve, to a lower pressure and caused to evaporate in an evaporator to thereby draw in heat and thus provide the desired cooling effect. The expanded, relatively low pressure vapor exiting the evaporator is once again drawn into the compressor and the cycle starts anew. The action of compressing the lower pressure vapor imparts work onto the higher pressure vapor and results in a significant increase in the vapor temperature. While a substantial portion of this heat caused by the compression process and the evaporating process is subsequently rejected to the atmosphere during the condensation process, a portion of the heat is transferred to the compressor components. Depending upon the specific refrigerant vapor compressed and on the pressure conditions of operation, this heat transfer can cause the temperature of the compressor components to rise to levels which may cause the compressor to overheat, resulting in degradation of the compressor's performance and lubrication and possible damage to the compressor.

In order to overcome overheating problems, various methods have been developed for injecting gaseous or liquid refrigerant under pressure into the closed pockets of the scroll compressor. One known prior art method of injecting the liquid refrigerant from the refrigerant cycle into the enclosed pockets is to inject the liquid refrigerant using an injection fitting which has an opening which is positioned in alignment with a suction inlet defined by one of the scroll members. The injected liquid is sucked into the closed pockets to cool the compressed gas. This method is described in Assignee's U.S. Pat. No. 5,076,067; the disclosure of which is incorporated herein by reference. Another known prior art method of liquid injection is to injert the liquid refrigerant from the refrigeration cycle directly into one or more of the closed pockets through an intermediate pressurized biasing chamber which is in communication with one or more of the closed pockets. The injected liquid cools the compressed gas in the closed pockets. This method is described in Assignee's U.S. Pat. Nos. 5,329,788 and 5,447,420; the disclosures of which are incorporated herein by reference. Another known prior art method of liquid injection is to inject the liquid refrigerant from the refrigeration cycle directly into one or more of the closed pockets through a passage extending through one of the scroll members and opening into one or more of the closed pockets at a position which is as close as possible to the central portion of the scroll member or as close as possible to the actual discharge. This method is described in Assignee's U.S. Pat. No. 5,469,816; the disclosure of which is incorporated herein by reference.

Each of these prior art systems offer advantages and disadvantages even though they perform successfully in the refrigeration compressors. The injection into the suction inlet of the scroll members offers simplicity but it also requires an additional fitting which extends through the hermetic shell. The systems that inject directly into one or more of the closed pockets are able to more accurately control the temperature but they require additional machining of the scroll members as well as requiring an additional fitting which extends through the hermetic shell of the scroll compressor.

The present invention overcomes these disadvantages by providing a simple yet effective method for injecting liquid refrigerant into the pockets formed by the scroll members to reduce the temperature of the compressed gas. The present invention uses a temperature sensing device on the top cap of the hermetic shell to sense the temperature of the discharge gas. When the discharge gas temperature exceeds a specified limit, an electronic control will open a device to inject a certain quantity of liquid refrigerant into the suction line of the scroll compressor. The injecting device can be an electronic expansion valve, a pulsing (pulse width modulator) valve or any other known method of having a controllable opening of a fluid passage. The method of the present invention provides an effective low cost liquid injection system which only requires simple modifications of the scroll compressor and the refrigeration system.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a schematic diagram of a refrigeration system incorporating a liquid injection system in accordance with another embodiment of the present invention.

DETAILED DESCRIPTION OF THE PREFERRED EMBODIMENTS

The following description of the preferred embodiments is merely exemplary in nature and is in no way intended to limit the invention, its application, or uses.

Figure 1:
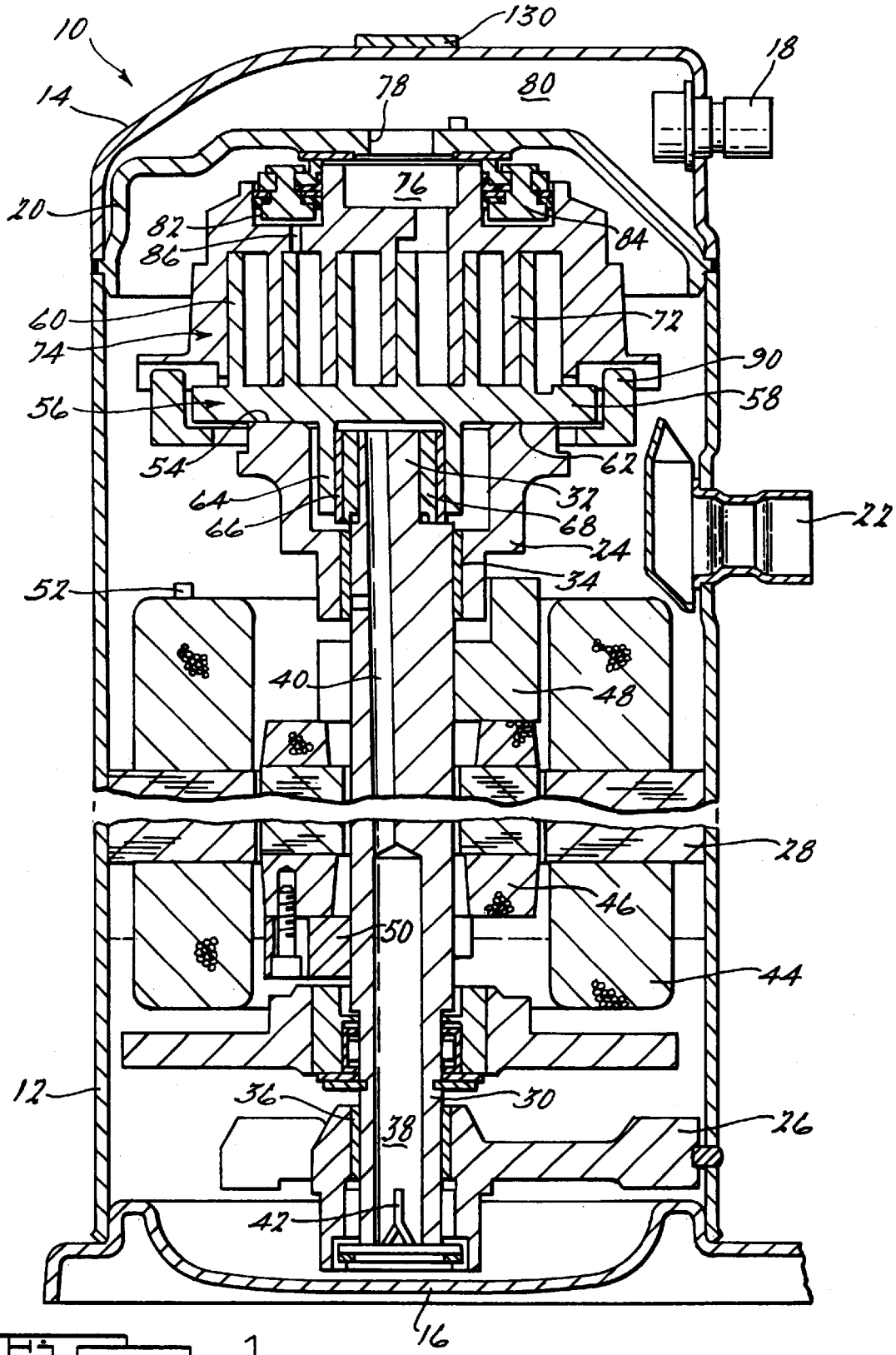
FIG. 1 is a vertical sectional view of a scroll compressor which incorporates the liquid injection system in accordance with the present invention.

Referring now to the drawings in which like reference numerals designate like or corresponding parts through the several views, there is shown in FIG. 1 a scroll compressor which incorporates the liquid injection system in accordance with the present invention and which is identified generally by reference numeral 10.

Scroll compressor 10 comprises a generally cylindrical hermetic shell 12 having welded at the upper end thereof a cap 14 and at the lower end thereof a base 16 having plurality of mounting feet (not shown) integrally formed therewith. Cap 14 is provided with a refrigerant discharge fitting 18 which may have the usual discharge valve therein (not shown). Other major elements affixed to hermetic shell 12 include a transversely extending partition 20 which is welded about its periphery at the same point cap 14 is welded to hermetic shell 12, an inlet fitting 22, a main bearing housing 24 which is suitably secured to hermetic shell 12 and a lower bearing housing 26 having a plurality of radially outwardly extending legs each of which is suitably secured to hermetic shell 12. A motor stator 28 which is generally square in cross-section but with the corners rounded off its press fit into hermetic shell 12. The flats between the rounded corners on stator 28 provide passageways between stator 28 and hermetic shell 12 which facilitate the return flow of the lubricant from the top of hermetic shell 12 to its bottom.

A drive shaft or crankshaft 30 having an eccentric crank pin 32 at the upper end thereof is rotatably journaled in a bearing 34 in main bearing housing 24 and in a bearing 36 in lower bearing housing 26. Crankshaft 30 has at the lower end thereof a relatively large diameter concentric bore 38 which communicates with a radially outwardly located small diameter bore 40 extending upwardly therefrom to the top of crankshaft 30. Disposed within bore 38 is a stirrer 42. The lower portion of the interior hermetic shell 12 is filled with lubricating oil and bores 38 and 40 act as a pump to pump the lubricating oil up crankshaft 30 and ultimately to all of the various portions of compressor 10 which require lubrication.

Crankshaft 30 is rotatably driven by an electric motor which includes motor stator 28 having windings 44 passing therethrough and a motor rotor 46 pressed fitted onto crankshaft 30 and having upper and lower counterweights 48 and 50, respectively. A motor protector 52, of the usual type, is provided in close proximity to motor windings 44 so that if the motor exceeds its normal temperature range, motor protector 52 will de-energize the motor.

The upper surface of main bearing housing 24 is provided with an annular flat thrust bearing surfaces 54 on which is disposed an orbiting scroll member 56. Scroll member 56 comprises an end plate 58 having the usual spiral valve or wrap 60 on the upper surface thereof and an annular flat thrust surface 62 on the lower surface thereof. Projecting downwardly from the lower surface is a cylindrical hub 64 having a journal bearing 66 therein and in which is rotatively disposed a drive bushing 68 having an inner bore within which crank pin 32 is drivingly disposed. Crank pin 32 has a flat on one surface (not shown) which drivingly engages a flat surface in a portion of the inner bore of drive bushing 68 to provide a radially compliant drive arrangement such as shown in Assignee's U.S. Pat. No. 4,877,382, the disclosure of which is incorporated herein by reference.

Wrap 60 meshes with a non-orbiting scroll wrap 72 forming part of a non-orbiting scroll member 74. During orbital movement of orbiting scroll member 56 with respect to non-orbiting scroll member 74 moving pockets of fluid are created which are compressed as the pockets move from a radially outer position to a central position of scroll members 56 and 74. Non-orbiting scroll member 74 is mounted to main bearing housing 24 in any desired manner which will provide limited axial movement of non-orbiting scroll member 74. The specific manner of such mounting is not critical to the present invention.

Non-orbiting scroll member 74 has a centrally disposed discharge port 76 which is in fluid communication via an opening 78 in partition 20 with a discharge muffler 80 defined by cap 14 and partition 20. Fluid compressed by the moving pockets between scroll wraps 60 and 72 discharges into discharge muffler 80 through discharge port 76 and opening 78. Non-orbiting scroll member 74 has in the upper surface thereof an annular recess 82 having parallel coaxial sidewalls within which is sealing disposed for relative axial movement an annular seal assembly 84 which serves to isolate the bottom of annular recess 82 so that it can be placed in fluid communication with a source of intermediate fluid pressure by means of a passageway 86. Non-orbiting scroll member 74 is thus axially biased against orbiting scroll member 56 by the forces created by discharge pressure acting on the central portion of non-orbiting scroll member 74 and the forces created by intermediate fluid pressure acting on the bottom of annular recess 82. This axial pressure biasing, as well as the various techniques for supporting non-orbiting scroll member 74 for limited axial movement are disclosed in much greater detail in Assignee's aforementioned U.S. Pat. No. 4,877,382.

Relative rotation of scroll members 56 and 74 is prevent by the usual Oldham Coupling 99 having a pair of key slidably disposed in diametrically opposing slots in non-orbiting scroll member 74 and a second pair of keys slidably disposed in diametrically opposed slots in orbiting scroll member 56.

Compressor 10 is preferably of the "low side" type in which suction gas entering hermetic shell 12 is allowed, in part, to assist in cooling the motor. So long as there is an adequate flow of returning suction gas, the motor will remain within the desired temperature limits. When this flow ceases, however, the loss of cooling will cause motor protector 52 to trip and shut compressor 10 down.

The scroll compressor, as thus broadly described, is either known in the art or it is the subject matter of other pending applications for patent by Applicant's assignee. The details of construction which incorporate the principles of the present invention are those which deal with a unique fluid injection system illustrated in FIG. 2 and identified generally by reference numeral 100. Fluid injection system 100 is used to inject liquid refrigerant for cooling purposes.

Liquid injection system 100 is illustrated in conjunction with a refrigeration circuit 102. Refrigeration circuit 102 comprises compressor 10 and a gas discharge line 104 connected to discharge fitting 18 for supplying high pressure refrigerant to a condenser 106. A liquid conduit 108 extends, from condenser 106 and branches into a normal flow line 110 and a liquid injection line 112. Completing the general operation of refrigeration circuit 102, line 110 communicates condensed relatively high pressure liquid refrigerant to an expansion valve 114 where it is expanded into relatively low pressure liquid and vapor. A fluid line 116 communicates the low pressure liquid and vapor to an evaporator 118 where the liquid evaporates, thereby absorbing heat and providing the desired cooling effect. Finally a return gas line on suction line 120 delivers the low pressure refrigerant vapor from evaporator 118 to suction inlet fitting 22 of compressor 10.

In order to provide cooling to compressor 10, liquid injection line 112 acts to extract a portion of the relatively high pressure liquid refrigerant from refrigeration circuit 102. A restrictor 122 is provided to restrict the amount of liquid extracted to an amount adequate to cool compressor 10 under high load operation. In the preferred embodiment, restrictor 122 is a precalibrated capillary tube. It should be understood however that restrictor 122 may also be a calibrated orifice, an adjustable screw type restriction on any other restriction known in the art. This extracted liquid is then communicated by a fluid line 124 through an electronic expansion valve 126 to suction line 120 where the liquid is injected into compressor 10 through suction inlet fitting 22 to effect cooling. Valve 126 is controlled by an electronic control unit 128 which is in communication with valve 126 and a temperature sensor 130 attached to the top cap 14. While temperature sensor 130 is illustrated as being attached to top cap 14, it is within the scope of the present invention to utilize other discharge temperature sensing devices known in the art such as temperature sensor 130' located on gas discharge line 104. Upon sensing a temperature in excess of a predetermined limit, control unit 128 opens electronic expansion valve 126 to inject a specified quantity of liquid refrigerant into suction line 120 of refrigeration circuit 102. The amount of liquid refrigerant that is injected is controlled by the opening of electronic expansion valve 126. The further that electronic expansion valve 126 is opened, the more liquid refrigerant is injected. Temperature sensor 130 working with electronic control unit 128 monitors the discharge temperature and controls valve 126 in such a manner than the discharge temperature is brought back into acceptable limits.

Thus, the present invention provides a unique liquid injection system that is low cost, efficient and able to be incorporated into a refrigeration system without extensive modifications being made to the compressor itself.

Referring now to FIG. 3, a liquid injection system 200 in accordance with another embodiment of the present invention is illustrated. Liquid injection system 200 is also illustrated in conjunction with refrigeration circuit 102. Refrigeration circuit 102 comprises compressor 10. Gas discharge line 104 connected to discharge fitting 18, condenser 106 liquid conduit 108, normal flow line 110, liquid injection line 112, expansion valve 114, fluid line 116, evaporator 118 and return gas line on suction line 120 connected to suction inlet fitting 22.

Liquid injection line 112 acts to extract a portion of the relatively high pressure liquid refrigerant from refrigerant circuit 102. Restrictor 122 is provided to restrict the amount of liquid extracted to an amount adequate to cool compressor 10 under high load operation. This extracted liquid is then communicated by fluid line 124 through a pulse width modulated solenoid valve 226 to suction line 120 where the liquid is injected into compressor 10 through suction inlet fitting 22 to effect cooling. Thus, liquid injection system 200 is the same as liquid injection system 100 except that electronic expansion valve 126 is replaced by pulse width modulated solenoid valve 226. Solenoid valve 226 is controlled by electronic control unit 128 which is in communication with solenoid valve 226 and temperature sensor 130 attached to top cap 14 or temperature sensor 130' attached to gas discharge line 104. Upon sensing a temperature in excess of a pre-determined limit, electronic control unit 128 sends a pulse width modulated signal to solenoid valve 226 to inject a specified quantity of liquid refrigerant into suction line 120 of refrigeration circuit 102. The amount of liquid refrigerant that is injected is controlled by the pulse width modulated signal which controls the opening time for solenoid valve 226. Temperature sensor 130 working with electronic control unit 128 monitors the discharge temperature and controls solenoid valve 226 in such a manner that the discharge temperature is brought back into acceptable limits.

Figure 2:
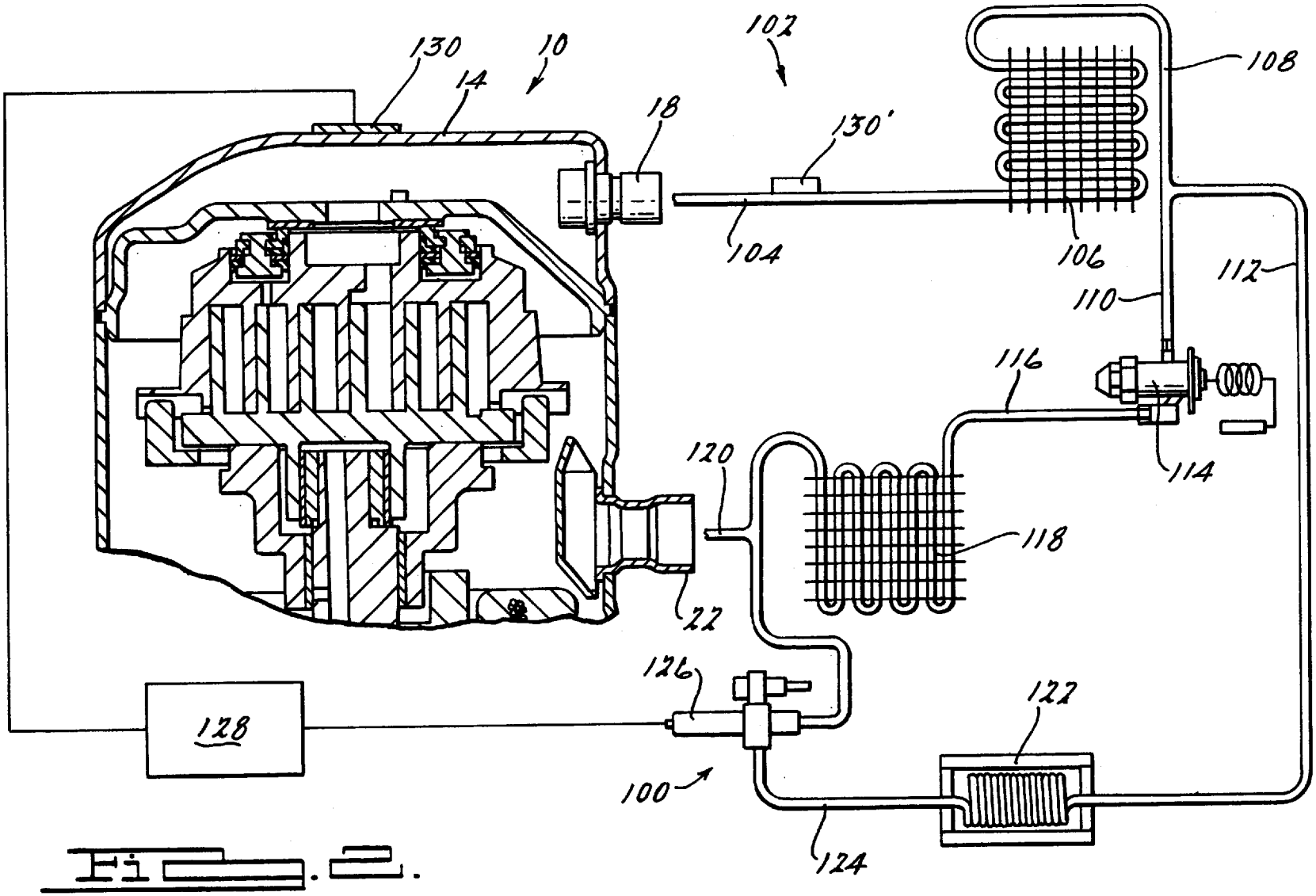
FIG. 2 is a schematic diagram of a refrigeration system incorporating the liquid injection system in accordance with the present invention.
Figure 2:
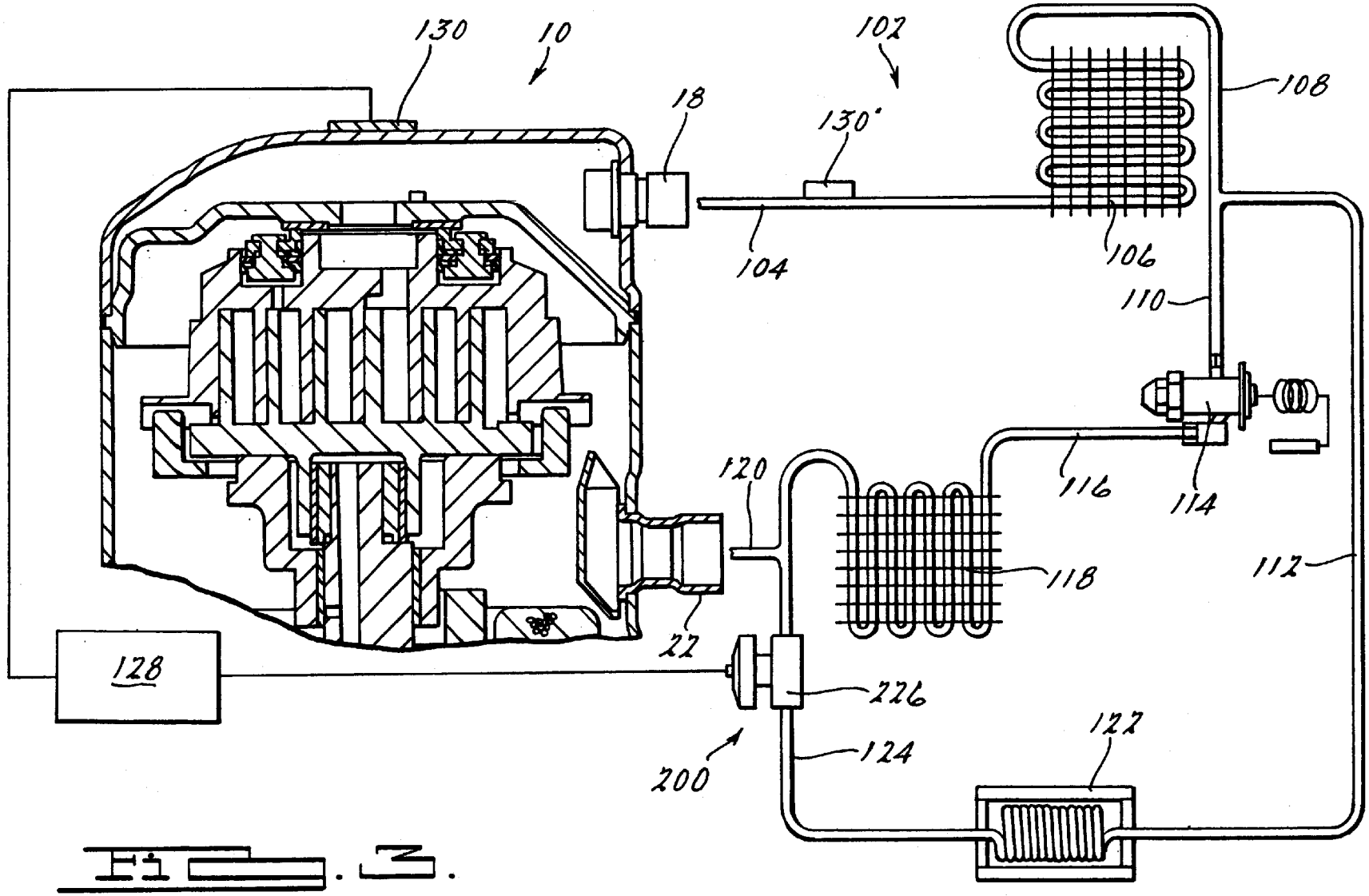

While FIGS. 2 and 3 illustrate electronic expansion valve 126 and solenoid valve 226, respectively, it is within the scope of the present invention to utilize any other known type of controllable valve in place of valve 126 or solenoid valve 226 if desired.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A compressor assembly comprising:

a shell defining a suction inlet and a discharge outlet;

a compressor disposed within said shell for receiving a fluid from said suction inlet and compressing said fluid from a suction pressure to a discharge pressure;

a refrigeration circuit extending between said discharge outlet and said suction inlet, said refrigeration circuit including a suction fluid line in communication with said suction inlet;

a liquid injection circuit extending between an attachment point in said refrigeration circuit and said suction fluid line for injecting liquid refrigerant into said suction fluid line;

a temperature sensor for monitoring a temperature of gas supplied to said discharge outlet at said discharge pressure;

a controllable valve for controlling flow of said liquid refrigerant to said suction fluid line, and an electronic control in communication with said temperature sensor and said controllable valve, said electronic control controlling said controllable valve by pulse width modulation based on a temperature reading of said temperature sensor.

2. The compressor assembly as claimed in claim 1 wherein said liquid injection circuit connects to said suction fluid line at a location external to said shell.

3. The compressor assembly as claimed in claim 1 wherein said controllable valve is an electronic expansion valve.

4. The compressor assembly as claimed in claim 1 wherein said controllable valve is a solenoid valve.

5. A scroll compressor assembly comprising:

a shell defining a suction inlet and a discharge outlet;

a first scroll member disposed in said shell and having a first scroll wrap extending from a first end plate;

a second scroll member disposed in said shell and having a second scroll wrap extending from a second end plate, said second scroll wrap being intermeshed with said first scroll wrap to define a plurality of closed pockets;

a drive mechanism for causing said second scroll member to orbit with respect to said first scroll member, said plurality of pockets moving from a radially outer position in communication with said suction inlet to a central position in communication with said discharge outlet;

a refrigeration circuit extending between said discharge outlet and said suction inlet, said refrigeration circuit including a suction fluid line in communication with said suction inlet;

a liquid injection circuit extending between an attachment point in said refrigeration circuit and said suction fluid line for injecting liquid refrigerant into said suction fluid line;

a temperature sensor for monitoring a temperature of gas supplied to said discharge outlet at said discharge pressure;

a controllable valve for controlling flow of said liquid refrigerant to said suction fluid line, and an electronic control in communication with said temperature sensor and said controllable valve, said electronic control controlling said controllable valve by pulse width modulation based on a temperature reading of said temperature sensor.

6. The compressor assembly as claimed in claim 5 wherein said liquid injection circuit connects to said suction fluid line at a location external to said shell.

7. The compressor assembly as claimed in claim 5 wherein said controllable valve is an electronic expansion valve.

8. The compressor assembly as claimed in claim 5 wherein said controllable valve is a solenoid valve.

* * * * *

UNITED STATES PATENT AND TRADEMARK OFFICE

CERTIFICATE OF CORRECTION

PATENT NO. : 6,615,598 B1 
DATED : September 8, 2003
INVENTOR(S) : Simon Y. Wang and Wayne R. Berry It is certified that error appears in the above-identified patent and that said Letters Patent is hereby corrected as shown below:

Column 2,
Line 7, “injert” should be -- inject --.

Column 3,
Line 34, “its” should be -- is --.
Line 62, “surfaces” should be -- surface --.

Column 4,
Line 28, “sealing” should be -- sealingly --.
Line 43, “prevent” should be -- prevented --.
Line 44, “key” should be -- keys --.

Column 5,
Line 44, “than” should be -- that --.
Line 55, after “106” insert -- , --.

Signed and Sealed this

Twenty-fifth Day of November, 2003

JAMES E. ROGAN
*Director of the United States Patent and Trademark Office*